US006351856B1

(12) United States Patent
Browne

(10) Patent No.: US 6,351,856 B1
(45) Date of Patent: Mar. 5, 2002

(54) TOILET SEAT LIFTING ASSEMBLY

(76) Inventor: Anthony G. Browne, 2615 Nicholson St. #202, West Hyattsville, MD (US) 20782

( * ) Notice: Subject to any disclaimer, the term of this patent is extended or adjusted under 35 U.S.C. 154(b) by 0 days.

(21) Appl. No.: 09/780,155

(22) Filed: Feb. 9, 2001

(51) Int. Cl.[7] ..... A47K 13/10
(52) U.S. Cl. ..... 4/246.2; 4/246.1
(58) Field of Search ..... 4/246.1, 246.2, 4/246.3, 246.4, 246.5

(56) References Cited

U.S. PATENT DOCUMENTS 2,092,707 A * 9/1937 Zulkoski ..... 4/246.2
2,849,728 A * 9/1958 Gyllengerg ..... 4/246.2
4,055,864 A 11/1977 Liu et al.
4,291,422 A * 9/1981 Shoemaker et al. ..... 4/251
5,014,367 A 5/1991 Gamblin
5,029,347 A * 7/1991 Lin ..... 4/251
5,307,524 A 5/1994 Veal
5,404,595 A 4/1995 Carmel
5,603,127 A 2/1997 Veal
D387,141 S 12/1997 Vargas Salas
5,963,991 A * 10/1999 Agosti et al. ..... 4/233

* cited by examiner

*Primary Examiner*—Gregory L. Huson
*Assistant Examiner*—Huyen Le

(57) ABSTRACT

A toilet seat lifting assembly for providing a more sanitary and easier way of raising and lifting a toilet seat. The toilet seat lifting assembly includes a lift member being adapted to be securely attached upon a toilet stool and being securely attached to a toilet seat; and also includes a lift activation assembly being connected to the lift member for energizing the lift member to lift the toilet seat.

9 Claims, 5 Drawing Sheets

TOILET SEAT LIFTING ASSEMBLY

BACKGROUND OF THE INVENTION

1. Field of the Invention

The present invention relates to an auto-lifting assembly for toilet seats and more particularly pertains to a new toilet seat lifting assembly for providing a more sanitary and easier way of raising and lifting a toilet seat.

2. Description of the Prior Art

The use of an auto-lifting assembly for toilet seats is known in the prior art. More specifically, an auto-lifting assembly for toilet seats heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,307,524; U.S. Pat. No. 4,055,864; U.S. Pat. No. 5,014,367; U.S. Pat. No. 5,404,595; U.S. Pat. No. 5,603,127; and U.S. Pat. No. Des. 387,141.

While these devices fulfill their respective, particular objectives and requirements, the aforementioned patents do not disclose a new toilet seat lifting assembly. The inventive device includes a lift member being adapted to be securely attached upon a toilet stool and being securely attached to a toilet seat; and also includes a lift activation assembly being connected to the lift member for energizing the lift member to lift the toilet seat.

In these respects, the toilet seat lifting assembly according to the present invention substantially departs from the conventional concepts and designs of the prior art, and in so doing provides an apparatus primarily developed for the purpose of providing a more sanitary and easier way of raising and lifting a toilet seat.

SUMMARY OF THE INVENTION

In view of the foregoing disadvantages inherent in the known types of auto-lifting assembly for toilet seats now present in the prior art, the present invention provides a new toilet seat lifting assembly construction wherein the same can be utilized for providing a more sanitary and easier way of raising and lifting a toilet seat.

The general purpose of the present invention, which will be described subsequently in greater detail, is to provide a new toilet seat lifting assembly which has many of the advantages of the auto-lifting assembly for toilet seats mentioned heretofore and many novel features that result in a new toilet seat lifting assembly which is not anticipated, rendered obvious, suggested, or even implied by any of the prior art auto-lifting assembly for toilet seats, either alone or in any combination thereof.

To attain this, the present invention generally comprises a lift member being adapted to be securely attached upon a toilet stool and being securely attached to a toilet seat; and also includes a lift activation assembly being connected to the lift member for energizing the lift member to lift the toilet seat.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toilet seat lifting assembly which has many of the advantages of the auto-lifting assembly for toilet seats mentioned heretofore and many novel features that result in a new toilet seat lifting assembly which is not anticipated, rendered obvious, suggested, or even implied by any of the prior art auto-lifting assembly for toilet seats, either alone or in any combination thereof.

It is another object of the present invention to provide a new toilet seat lifting assembly which may be easily and efficiently manufactured and marketed.

It is a further object of the present invention to provide a new toilet seat lifting assembly which is of a durable and reliable construction.

An even further object of the present invention is to provide a new toilet seat lifting assembly which is susceptible of a low cost of manufacture with regard to both materials and labor, and which accordingly is then susceptible of low prices of sale to the consuming public, thereby making such toilet seat lifting assembly economically available to the buying public.

Still yet another object of the present invention is to provide a new toilet seat lifting assembly which provides in the apparatuses and methods of the prior art some of the advantages thereof, while simultaneously overcoming some of the disadvantages normally associated therewith.

Still another object of the present invention is to provide a new toilet seat lifting assembly for providing a more sanitary and easier way of raising and lifting a toilet seat.

Yet another object of the present invention is to provide a new toilet seat lifting assembly which includes a lift member being adapted to be securely attached upon a toilet stool and being securely attached to a toilet seat; and also includes a lift activation assembly being connected to the lift member for energizing the lift member to lift the toilet seat.

Still yet another object of the present invention is to provide a new toilet seat lifting assembly that allows user's to lift the toilet seat without having to touch the toilet seat which eliminates bacteria from being transmitted to the user.

Even still another object of the present invention is to provide a new toilet seat lifting assembly that lowers the toilet seat automatically without the user having to remember to lower the toilet seat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
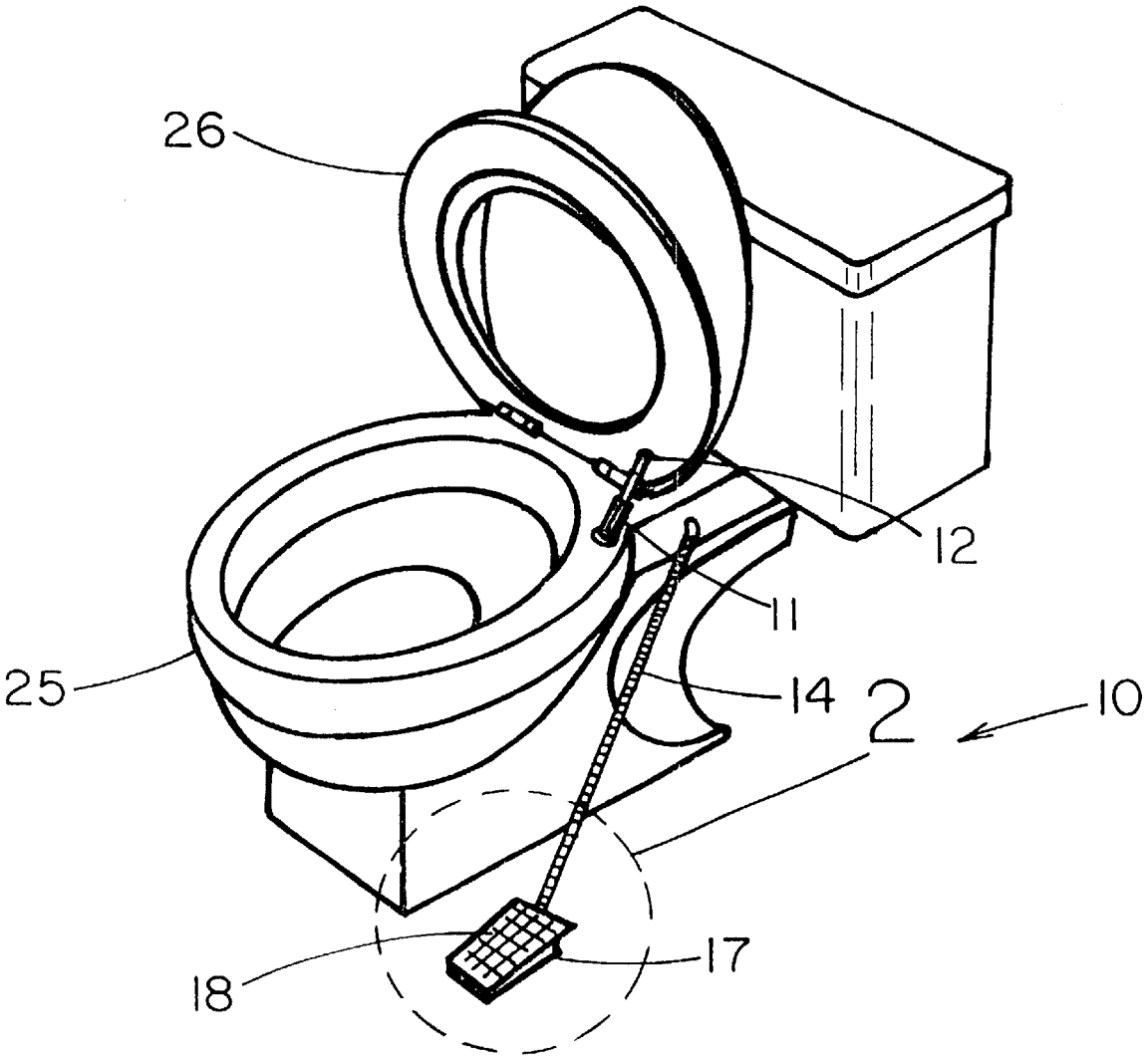
FIG. 1 is a perspective view of a new toilet seat lifting assembly according to the present invention.
Figure 2:
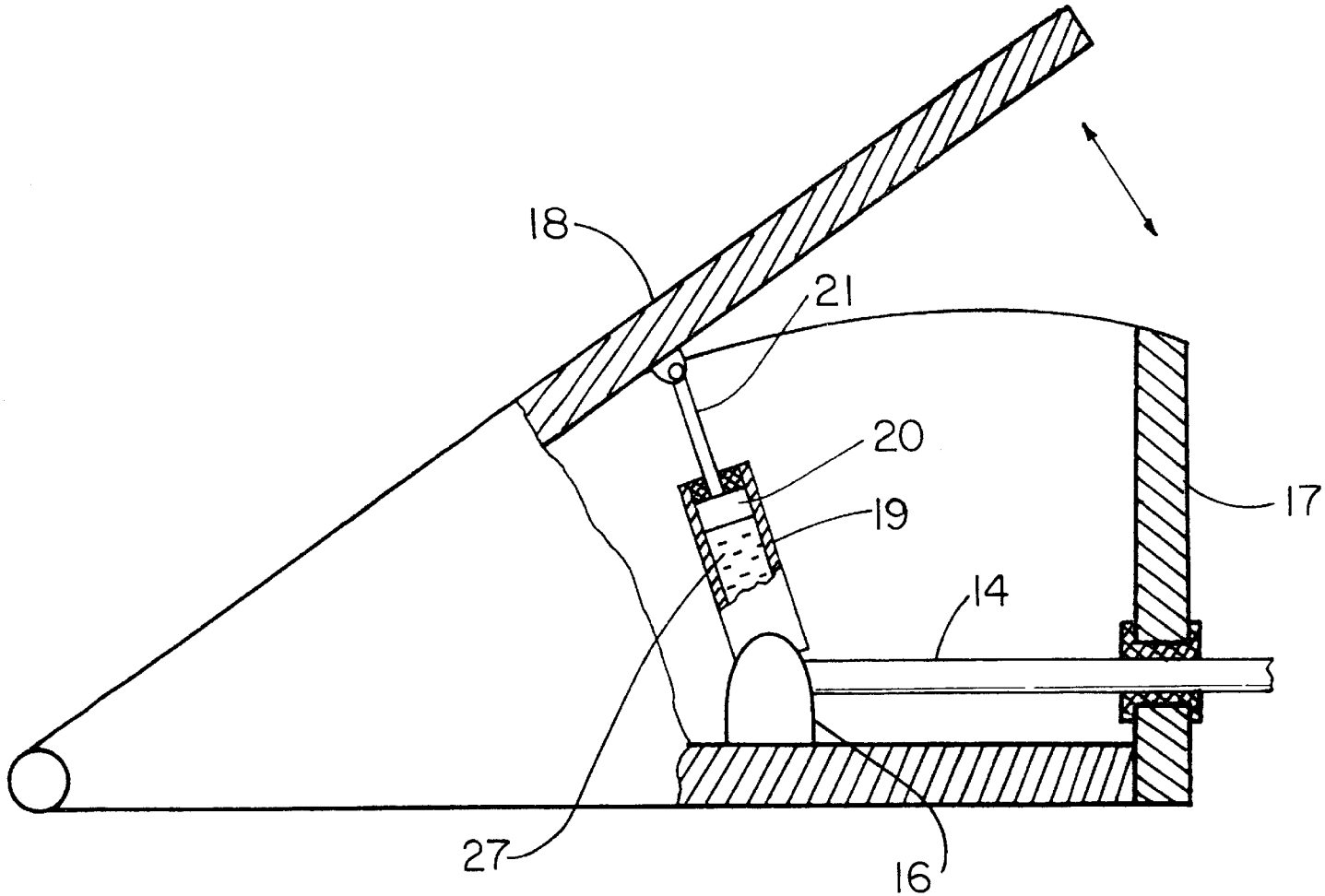
FIG. 2 is a detailed partial cross-sectional view of the foot pedal of the present invention.
Figure 3:
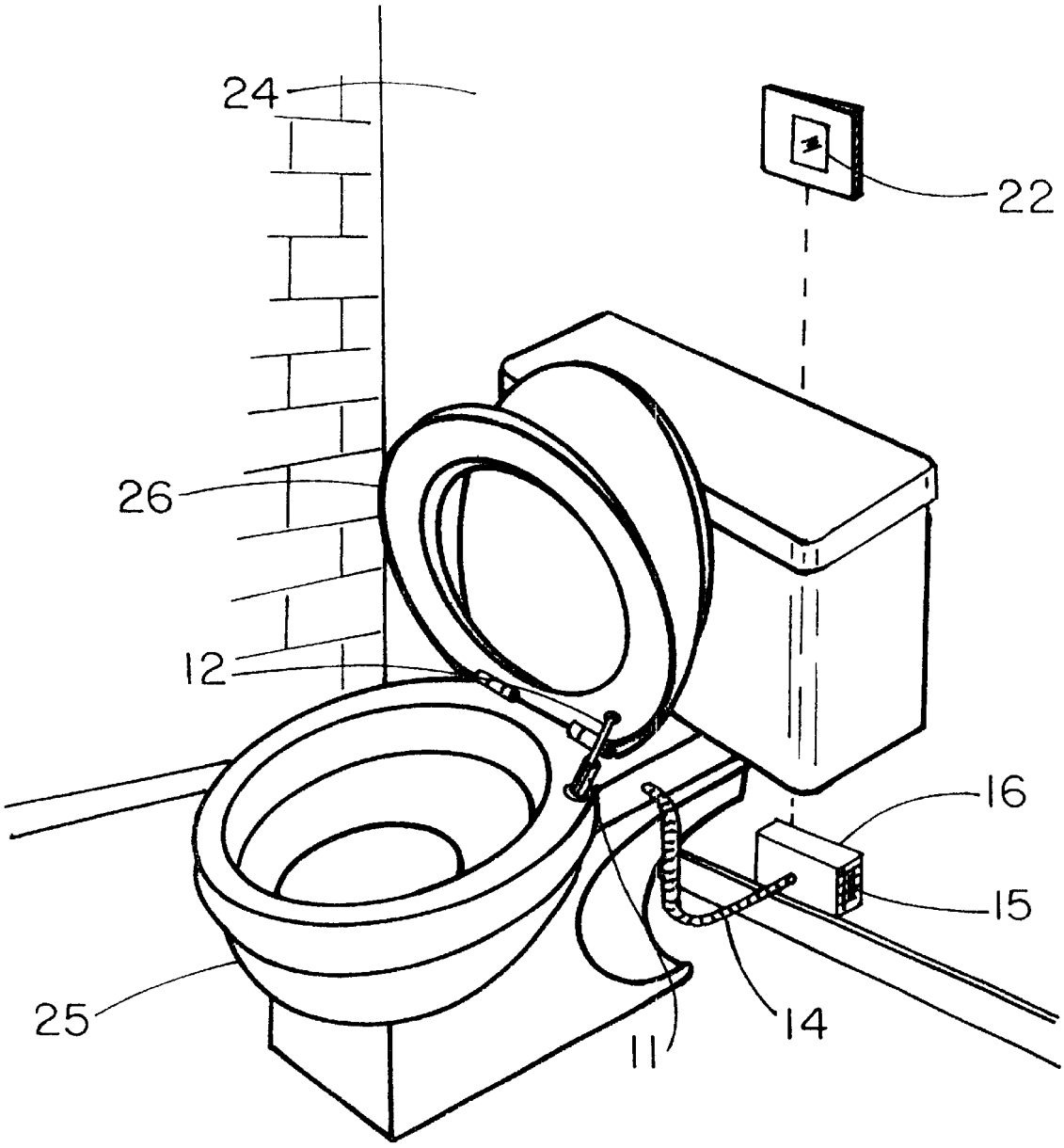
FIG. 3 is a perspective view of a second embodiment of the present invention.
Figure 4:
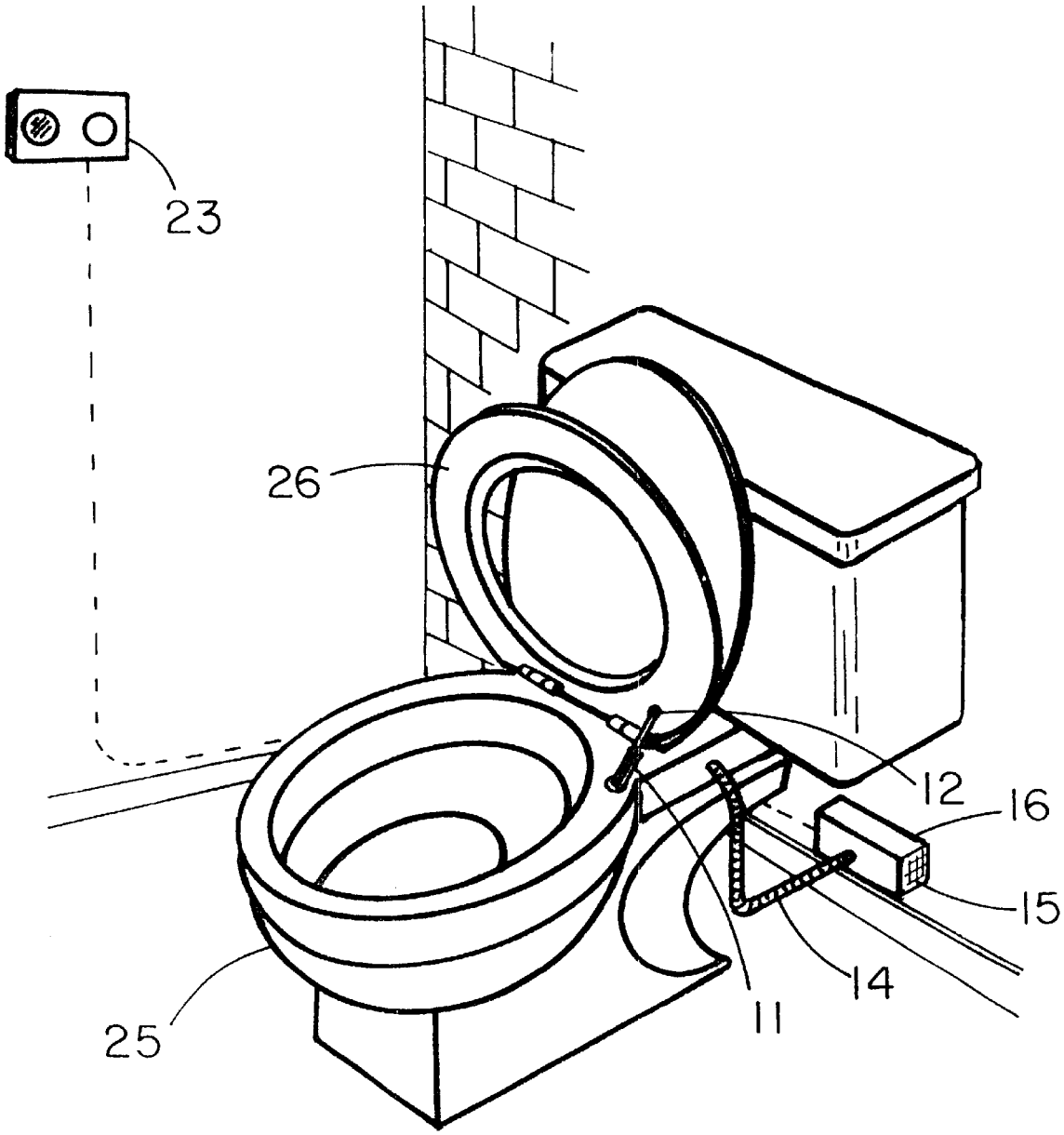
FIG. 4 is a perspective view of a third embodiment of the present invention.
Figure 5:
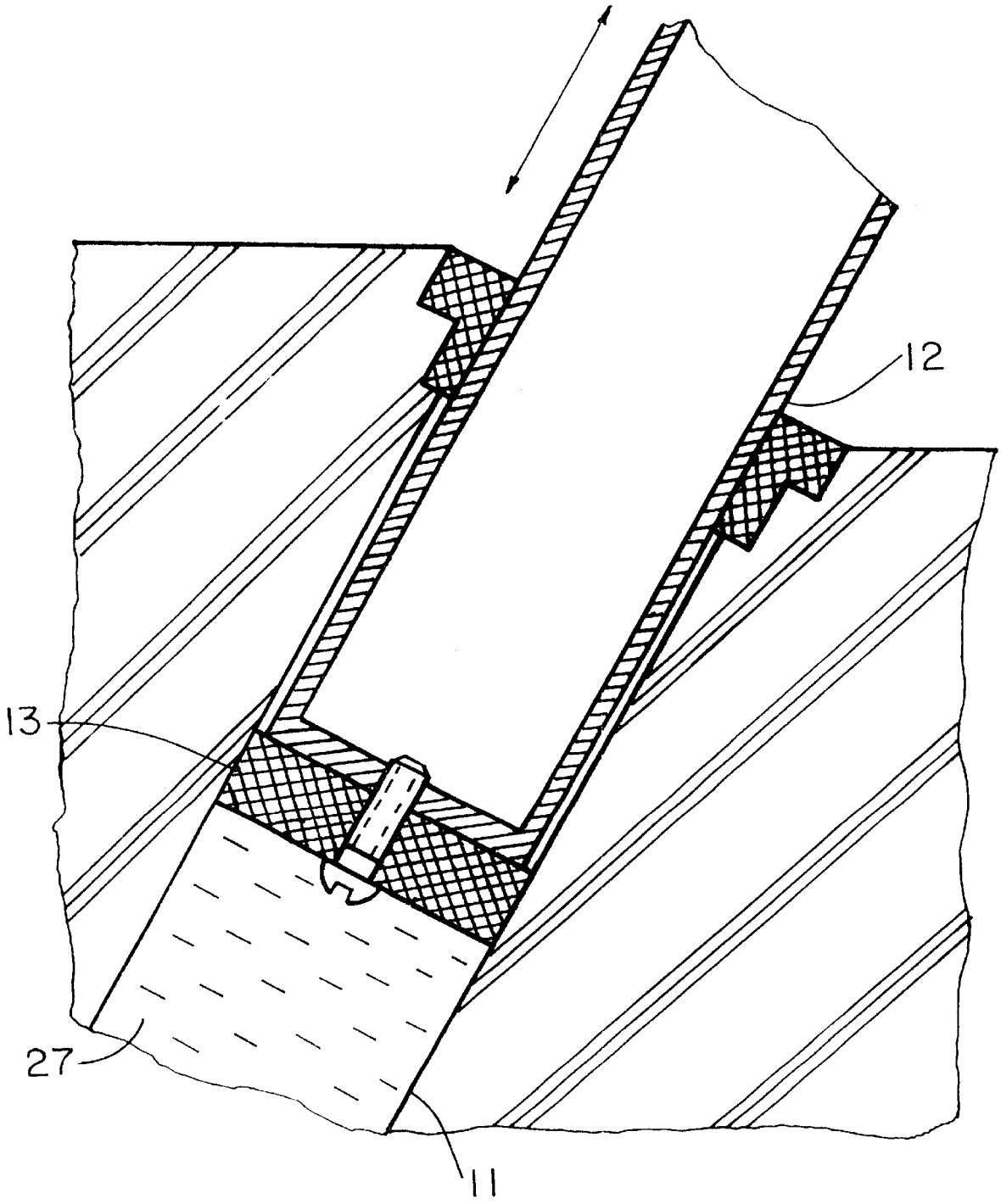
FIG. 5 is a cross-sectional view of the lift member of the present invention.

With reference now to the drawings, and in particular to FIGS. 1 through 5 thereof, a new toilet seat lifting assembly embodying the principles and concepts of the present invention and generally designated by the reference numeral 10 will be described.

As best illustrated in FIGS. 1 through 5, the toilet seat lifting assembly 10 generally comprises a lift member 11–13 being adapted to be securely and conventionally attached upon a toilet stool 25 and being securely and conventionally attached to a toilet seat 26. The lift member 11–13 includes a hydraulic cylinder 11 being adapted to be securely and conventionally mounted upon a rim of the toilet stool 25, and also includes a piston 12 being fastenably attached to a seal member 13 and being movably disposed in and out of the hydraulic cylinder 11 and being conventionally attached to an underside of the toilet seat 26.

A lift activation assembly is conventionally connected to the lift member 11–13 for energizing the lift member 11–13 to lift the toilet seat 26. The lift activation assembly includes a hose 14 being conventionally connected to the hydraulic cylinder 11, and also includes a hydraulic pump 15 being conventionally connected to the hose 14, and further includes a hydraulic fluid reservoir 16 being conventionally connected to the hydraulic pump 15 and to the hose 14 for supplying hydraulic fluid 27 to the hydraulic cylinder 11.

As a first embodiment, the hydraulic pump 15 includes a base housing 17, and also includes a foot pedal 18 being hingedly attached to the base housing 17, and further includes a cylinder member 19 being disposed in the base housing 17 and being conventionally connected to the hose 14, and also includes a plunger 20 being movably disposed in the cylinder member 19, and further includes a linkage member 21 being conventionally attached to the plunger 20 and to the foot pedal 18 for moving the plunger 20 within the cylinder member 19 and for urging hydraulic fluid 27 through the hose 14 to the hydraulic cylinder 11 which urges the piston 12 out of the hydraulic cylinder 11 with the hose 14 extending through a wall of the base housing 17.

As a second embodiment, the lift activation assembly further includes a motion-detecting sensor 22 being adapted to conventionally mount upon a wall structure 24 which is located behind the toilet stool 25, and being conventionally connected to the hydraulic pump 15 which is adapted to be securely and conventionally mounted to a base of the wall structure 24.

As a third embodiment, the lift activation assembly further includes an on/off switch 23 being adapted to be securely and conventionally mounted upon a wall structure and being connected with wires to the hydraulic pump 15 for the energizing of the hydraulic pump 15.

In use, the user raises the toilet seat 26 by either pressing upon the foot pedal 18 which urges the plunger 20 to drive the hydraulic fluid 27 from the hydraulic fluid reservoir 16 to the hydraulic cylinder 11 to move the piston 12 out of the hydraulic cylinder, or simply standing in front of the motion-detecting sensor 22 which energizes the hydraulic pump 15, or by turning on the on/off switch 23 which energizes the hydraulic pump 15.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toilet seat lifting assembly comprising:

a lift member being adapted to be securely attached upon a toilet stool and being securely attached to a toilet seat; and a lift activation assembly being connected to said lift member for energizing said lift member to lift the toilet seat; wherein said lift member includes a hydraulic cylinder embedded in a rim of the toilet stool and extended upwardly therefrom, and a piston being attached to a seal member and being movably disposed in and out of said hydraulic cylinder and being attached to an underside of the toilet seat for lifting the toilet seat.

2. A toilet seat lifting assembly as described in claim 1, wherein said lift activation assembly includes a hose being connected to said hydraulic cylinder, and also includes a hydraulic pump being connected to said hose, and further includes a hydraulic fluid reservoir being connected to said hydraulic pump and to said hose for supplying hydraulic fluid to said hydraulic cylinder.

3. A toilet seat lifting assembly as described in claim 2, wherein said hydraulic pump includes a base housing, and also includes a foot pedal being hingedly attached to said base housing, and further includes a cylinder member being disposed in said base housing and being connected to said hose, and also includes a plunger being movably disposed in said cylinder member, and further includes a linkage member being attached to said plunger and to said foot pedal for moving said plunger within said cylinder member and for urging hydraulic fluid through said hose to said hydraulic cylinder which urges said piston out of said hydraulic cylinder, said hose extending through a wall of said base housing.

4. A toilet seat lifting assembly as described in claim 2, wherein said lift activation assembly further includes a motion-detecting sensor being adapted to mount upon a wall structure which is located behind the toilet, and being connected to said hydraulic pump which is adapted to be securely mounted to a base of the wall structure.

5. A toilet seat lifting assembly as described in claim 2, wherein said lift activation assembly further includes an on/off switch being adapted to be securely mounted upon a wall structure and being connected with wires to said hydraulic pump for the energizing of said hydraulic pump.

6. A toilet seat lifting assembly comprising:

a lift member being adapted to be securely attached upon a toilet stool and being securely attached to a toilet seat, said lift member including a hydraulic cylinder embedded in a rim of the toilet stool and extended upwardly therefrom, and also including a piston and being attached to a seal member and being movably disposed in and out of said hydraulic cylinder and being attached to an underside of the toilet seat; and a lift activation assembly being connected to said lift member for energizing said lift member to lift the toilet seat, said lift activation assembly including a hose being connected to said hydraulic cylinder, and also including a hydraulic pump being connected to said hose, and further including a hydraulic fluid reservoir being connected to said hydraulic pump and to said hose for supplying hydraulic fluid to said hydraulic cylinder.

7. A toilet seat lifting assembly as described in claim 6, wherein said hydraulic pump includes a base housing, and also includes a foot pedal being hingedly attached to said base housing, and further includes a cylinder member being disposed in said base housing and being connected to said hose, and also includes a plunger being movably disposed in said cylinder member, and further includes a linkage member being attached to said plunger and to said foot pedal for moving said plunger within said cylinder member and for urging hydraulic fluid through said hose to said hydraulic cylinder which urges said piston out of said hydraulic cylinder, said hose extending through a wall of said base housing.

8. A toilet seat lifting assembly as described in claim 6, wherein said lift activation assembly further includes a motion-detecting sensor being adapted to mount upon a wall structure which is located behind the toilet, and being connected to said hydraulic pump which is adapted to be securely mounted to a base of the wall structure.

9. A toilet seat lifting assembly as described in claim 6, wherein said lift activation assembly further includes an on/off switch being adapted to be securely mounted upon a wall structure and being connected with wires to said hydraulic pump for the energizing of said hydraulic pump.

* * * * *